US011841212B2

(12) United States Patent
Maguire

(10) Patent No.: US 11,841,212 B2
(45) Date of Patent: Dec. 12, 2023

(54) BODY SHIELD FOR PROVIDING PROTECTION AGAINST SHARP OBJECT PENETRATION AND PHYSICAL ATTACK

(71) Applicant: Jeffrey Gerard Maguire, Houlton, ME (US)

(72) Inventor: Jeffrey Gerard Maguire, Houlton, ME (US)

( * ) Notice: Subject to any disclaimer, the term of this patent is extended or adjusted under 35 U.S.C. 154(b) by 71 days.

(21) Appl. No.: 17/406,087

(22) Filed: Aug. 19, 2021

(65) Prior Publication Data

US 2022/0065589 A1 Mar. 3, 2022

Related U.S. Application Data

(60) Provisional application No. 63/070,949, filed on Aug. 27, 2020.

(51) Int. Cl.

| | |
|---|---|
| ***F41H 5/08*** | (2006.01) |
| ***A45F 3/04*** | (2006.01) |
| ***F41H 1/02*** | (2006.01) |
| *A45F 3/00* | (2006.01) |

(52) U.S. Cl.
CPC ..... *F41H 5/08* (2013.01); *A45F 3/04* (2013.01); *F41H 1/02* (2013.01); *A45F 2003/003* (2013.01)

(58) Field of Classification Search
CPC ..... F41H 5/08; F41H 1/02; A45F 3/04; A45F 3/003
USPC ..... 89/36.05, 36.01, 36.02
See application file for complete search history.

(56) References Cited

U.S. PATENT DOCUMENTS

| | | | | |
|---|---|---|---|---|
| 4,546,863 | A | 10/1985 | Kaufman | |
| 4,830,245 | A | 5/1989 | Arakaki | |
| 4,919,037 | A | 4/1990 | Mitchell | |
| 5,329,636 | A * | 7/1994 | Siddle | F41H 5/08 2/92 |
| 5,377,577 | A | 1/1995 | Bounkong et al. | |
| 6,000,347 | A | 12/1999 | Madden, Jr. | |
| 6,161,738 | A | 12/2000 | Norris | |
| 6,419,132 | B1 | 7/2002 | Reed et al. | |

(Continued)

FOREIGN PATENT DOCUMENTS

| | | | |
|---|---|---|---|
| CN | 1081346 | A | 2/1994 |
| CN | 103884239 | A | 6/2014 |

(Continued)

OTHER PUBLICATIONS

"Mundbora Personal Protection Backpack" by Maguire Protective Services, Inc., Found Online on [Sep. 22, 2021] https://www.mundbora.com/product-page/mundbora-personal-protection-backpack.

(Continued)

*Primary Examiner* — John Cooper
(74) *Attorney, Agent, or Firm* — LEGALFORCE RAPC WORLDWIDE

(57) ABSTRACT

Disclosed are a method and/or a system of forming a body shield for providing protection against a sharp object penetration and/or a physical attack. The body shield includes a cavity formed in an interior portion of the body shield in which items can be stored. In addition, the body shield includes a plurality of horizontal straps affixed on a back side of the body shield. The plurality of horizontal straps is configured to enable a user of the body shield, to maneuver the body shield on a human arm, to shield against the physical attack.

3 Claims, 8 Drawing Sheets

(56) References Cited

U.S. PATENT DOCUMENTS

| | | | | |
|---|---|---|---|---|
| 6,681,400 | B1 | 1/2004 | Mills | |
| 6,685,071 | B2 | 2/2004 | Prather | |
| 7,146,899 | B2 | 12/2006 | Imblum et al. | |
| 7,222,705 | B1 | 5/2007 | Guza | |
| 7,441,278 | B2 | 10/2008 | Blakeley | |
| 7,522,410 | B2 | 4/2009 | Pichahchi | |
| 7,971,516 | B2 | 7/2011 | Hogan | |
| 8,671,820 | B1 | 3/2014 | Keyfauver et al. | |
| 9,609,928 | B2 | 4/2017 | Gerdes | |
| 9,726,458 | B2 | 8/2017 | Weekly | |
| 9,820,558 | B1 | 11/2017 | de Geus | |
| 9,861,145 | B2 | 1/2018 | McIntire, Jr. | |
| 10,098,441 | B1 | 10/2018 | Holloman et al. | |
| 10,130,160 | B1 * | 11/2018 | Cheng | A45F 4/02 |
| 10,188,197 | B2 | 1/2019 | Fraile Nuez | |
| 10,213,008 | B2 | 2/2019 | Weaver, Jr. et al. | |
| 10,231,533 | B2 | 3/2019 | Vaughan et al. | |
| 10,299,570 | B2 | 5/2019 | Kim et al. | |
| 10,306,971 | B2 | 6/2019 | Zhang | |
| 10,648,779 | B1 * | 5/2020 | Scalli | B32B 15/06 |
| 10,697,735 | B2 | 6/2020 | Liu | |
| 10,835,795 | B1 * | 11/2020 | Wilson | A63B 69/26 |
| 10,939,713 | B2 | 3/2021 | Walsh et al. | |
| 11,022,405 | B2 | 6/2021 | Alter | |
| 11,026,501 | B1 | 6/2021 | Dabrowka | |
| 11,330,894 | B2 * | 5/2022 | Rushing | A45F 4/02 |
| 2007/0295772 | A1 | 12/2007 | Woodmansee | |
| 2009/0014490 | A1 | 1/2009 | Bradley | |
| 2011/0097021 | A1 * | 4/2011 | Curran | A45F 3/06 190/125 |
| 2012/0180636 | A1 | 7/2012 | Seuk | |
| 2012/0266344 | A1 | 10/2012 | Griffin | |
| 2014/0233235 | A1 | 8/2014 | Micarelli | |
| 2015/0020296 | A1 | 1/2015 | Oberle | |
| 2015/0047940 | A1 | 2/2015 | Casas | |
| 2015/0048133 | A1 | 2/2015 | Alba et al. | |
| 2015/0082524 | A1 | 3/2015 | Ben David | |
| 2017/0099933 | A1 | 4/2017 | Drake | |
| 2017/0276457 | A1 | 9/2017 | Chapman | |
| 2018/0003466 | A1 | 1/2018 | Rose et al. | |
| 2018/0120063 | A1 | 5/2018 | Yakoub | |
| 2018/0160793 | A1 | 6/2018 | Duthoit | |
| 2018/0235352 | A1 * | 8/2018 | Jones | A41D 15/04 |
| 2018/0317635 | A1 | 11/2018 | Quon-Chow et al. | |
| 2019/0154405 | A1 | 5/2019 | Burnau et al. | |
| 2019/0174903 | A1 | 6/2019 | Holder | |
| 2019/0208896 | A1 | 7/2019 | Schmidt et al. | |
| 2019/0216189 | A1 | 7/2019 | Liu et al. | |
| 2019/0339044 | A1 | 11/2019 | Arranz | |
| 2019/0380478 | A1 * | 12/2019 | Rushing | A45F 4/02 |
| 2020/0025523 | A1 | 1/2020 | Ross | |
| 2020/0217622 | A1 | 7/2020 | James | |
| 2020/0263959 | A1 | 8/2020 | Dieffenbach | |
| 2021/0161264 | A1 | 6/2021 | Taha | |
| 2021/0212426 | A1 | 7/2021 | Huang | |
| 2021/0386168 | A1 * | 12/2021 | Younger | A45C 13/1038 |

FOREIGN PATENT DOCUMENTS

| | | | | |
|---|---|---|---|---|
| DE | 202018000940 | U1 | 4/2018 | |
| DE | 202018000940 | U1 * | 5/2018 | A45C 15/06 |
| EP | 2037207 | A2 | 3/2009 | |
| EP | 3272245 | A1 | 1/2018 | |
| JP | 2004267386 | A | 9/2004 | |
| JP | 2010121855 | A | 6/2010 | |
| JP | 4609281 | B2 | 1/2011 | |
| KR | 200458421 | Y1 | 2/2012 | |
| KR | 20120009011 | U | 12/2012 | |
| WO | 2003062736 | A1 | 7/2003 | |
| WO | 2014101245 | A1 | 7/2014 | |
| WO | 2016167714 | A1 | 10/2016 | |
| WO | 2018235047 | A1 | 12/2018 | |
| WO | 2019126918 | A1 | 7/2019 | |
| WO | 2019144028 | A1 | 7/2019 | |
| WO | WO-2019144028 | A1 * | 7/2019 | A45F 3/04 |
| WO | 2019170208 | A1 | 9/2019 | |
| WO | 2020182982 | A1 | 9/2020 | |

OTHER PUBLICATIONS

"Funded—Shield—The Anti Theft/Cut/Stab Backpack" by TRIP-PRO, Published Online on [Sep. 28, 2017] https://www.kickstarter.com/projects/tripprogear/shield-the-first-stab-cut-and-theft-proof-backpack.

"The Best NIJ III Bulletproof Backpack" by Atomic Defense, Found Online on [Sep. 22, 2021] https://www.atomicdefense.com/collections/nij-iii-bulletproof-backpacks/products/best-bulletproof-backpack-anti-theft-usb-charging.

"NIJ IIIA Bulletproof Full Length Shield Briefcase" by Bullet Blocker, Found Online on [Sep. 22, 2021] https://www.bulletblocker.com/bulletblocker-nij-iiia-bulletproof-dropdown-briefcase.html.

"Bulletproof Briefcase Ballistic Body Armor Safe Bag NIJ Level IIIA Plate Insert Portfolio Tactical Concealed Briefcase" by AA Shield, Found Online on [Sep. 22, 2021] https://www.aliexpress.com/i/32941098026.html.

"Guard Dog Proshield Flex—Bulletproof Backpack" by Guard Dog Security, Found Online on [Sep. 22, 2021] https://bulletproofzone.com/products/guard-dog-proshield-flex-bulletproof-backpack.

* cited by examiner

BODY SHIELD FOR PROVIDING PROTECTION AGAINST SHARP OBJECT PENETRATION AND PHYSICAL ATTACK

CLAIM OF PRIORITY

This application is a U.S. Utility Conversion Patent Application of U.S. Provisional Patent Application No. 63/070,949 titled PERSONAL PROTECTION BACK-PACK filed on Aug. 27, 2020. The content of the aforementioned application is incorporated by reference in entirety thereof.

FIELD OF TECHNOLOGY

This disclosure relates generally to the field of protective devices, and, more particularly, to a method and system of forming a body shield for providing protection against a sharp object penetration and/or a physical attack.

BACKGROUND

A person may have concerns for personal safety while being in a public place (e.g., community hall, garden, school, etc.) and/or a private place (e.g., home, office, etc.). The person may be a subject of sudden violent physical attack, such as a knife, firearm, and/or an animal attack. The person may not have a handy tool to protect himself/herself from such an unanticipated attack. A protective covering (e.g., an armor, shield) may be used to defend from such physical attack. However, the protective covering available to counter such a physical attack may offer limited protection since they must be situated at a particular part of the person's body, leaving the remaining parts of the body unprotected. Further, the protective covering may be inconvenient to carry, and is cumbersome.

In addition, the person may need to be trained appropriately to be able to optimally use such protective covering in various situations. However, the person may not be trained to adequately use such protective covering, making the protective covering impractical for personal use. In the absence of an appropriate, convenient protective covering and/or a security device, the individual may be vulnerable to the physical attack.

SUMMARY

Disclosed are a method and/or a system of forming a body shield for providing protection against a sharp object penetration and/or a physical attack.

In one aspect, a body shield includes a cavity formed in an interior portion of the body shield in which items can be stored. In addition, the body shield includes a plurality of horizontal straps affixed on a back side of the body shield. The plurality of horizontal straps is configured to enable a user of the body shield to maneuver the body shield on a human arm, to shield against a physical attack.

The plurality of horizontal straps may include an upper strap, a middle strap, and a lower strap. The upper strap may be anchored at a top end of the back side of the body shield that may optionally connect with a hand grip on an upper top of the body shield through a fastener. The middle strap may enable the user to securely hold the body shield in a middle of a forearm of the user. The lower strap may comfortably affix near an elbow of the user to provide secure rotation of the body shield while minimizing the chance of the body shield falling off from the human arm of the user.

A pair of vertical straps may be affixed at the back side of the body shield to enable the user to carry the body shield and the items stored in the cavity on a human back. The pair of vertical straps may be detachably affixed at the back side of the body shield using a hook and loop fastener, a button fastener, a buckle fastener, and/or an interlocking clasp fastener.

A high-modulus polyethylene material may form a front side of the body shield, to provide protection from a sharp object penetration. The front side of the body shield may be configured to enable the user to prevent grabbing, deflect the physical attack, and/or prevent theft.

The upper strap may be formed sturdier than the middle strap and/or the lower strap to enable a firm grip to hold the body shield. The upper strap may be wrapped with a hard foam-like material. The hand grip may be configured to enable the user to carry the body shield with a single hand.

The middle strap may be situated approximately at a one-fourth of the distance from the top end of the back side of the body shield to enable the user to securely hold the body shield in the middle of the forearm of the user in a defensive position. The lower strap may be situated approximately one-fourth of the distance from a bottom end of the back side of the body shield. The lower strap may be configured to enable the user to rout his hand under the middle strap to grasp the upper strap with hand to hold the body shield in the defensive position.

At least one vertical strap of the pair of vertical straps may be removably covered with a shoulder pad. The shoulder pad may include a concealed pouch to hold a heavy object, a metal, and/or a valuable item. The shoulder pad may be used to drive off the attacker by wielding the shoulder pad against an attacker.

The cavity formed in the interior portion of the body shield may be configured to receive an anti-stab board insert, an assault board insert, an anti-trauma pad, and/or a bullet-proof protective board insert. The body shield may be a backpack, a laptop carrier, an attaché case, a daypack, a tactical backpack, a sling bag, and/or a tote backpack.

In another aspect, a method of fabricating a body shield includes forming a cavity in an interior portion of the body shield to store a plurality of articles, and affixing a plurality of horizontal straps on a back portion of the body shield. The plurality of horizontal straps are configured to enable a user of the body shield to maneuver the body shield on a human arm of the user, to shield against a physical attack.

The method may include anchoring an upper strap at a top end of the back portion of the body shield, anchoring a middle strap, and anchoring a lower strap. The upper strap may optionally connect with a hand grip affixed on an upper top of the body shield through a fastener. The middle strap may enable the user to securely hold the body shield in a middle of a forearm of the user. The lower strap may comfortably affix near an elbow of the user to provide secure rotation of the body shield while minimizing the chance of the body shield falling off from the human arm of the user.

The method may further include forming a front portion of the body shield using a high-modulus polyethylene material to provide protection from a sharp object penetration. In addition, the method may include affixing a pair of vertical straps at a back portion of the body shield to enable the user to carry the body shield and the articles stored in the cavity on a human back of the user. The pair of vertical straps may be detachably affixed at the back side of the body shield using a hook and loop fastener, a button fastener, a buckle fastener, and/or an interlocking clasp fastener.

Further, the method may include configuring the body shield to function as a backpack, a laptop carrier, an attaché case, a daypack, a tactical backpack, a sling bag, and/or a tote backpack.

In addition, the method may include configuring the hand grip on the upper top of the body shield to enable the user to carry the body shield with a single hand. The method may include partitioning the cavity at the interior portion of the body shield to receive an anti-stab board insert, an assault board insert, and/or a bulletproof protective board insert.

Additionally, the method may include affixing the middle strap approximately at a one-fourth of the distance from the top end of the back side of body shield to enable the user to grasp the middle strap with hand to hold the body shield in the defensive position, and affixing the lower strap approximately one-fourth of the distance from the bottom end of the back side of the body shield. The lower strap may be configured to enable the user to rout his hand under the middle strap to grasp the upper strap with hand to hold the body shield in the defensive position.

Further, the method may include configuring the body shield to enable the user to manipulatively rotate the body shield in all the directions in 360 degrees, with the body shield affixed onto the human arm of the user in a defensive position, depending on a direction of attack.

In yet another aspect, a body shield includes a cavity formed in an interior portion of the body shield in which items can be stored, and a plurality of horizontal straps affixed on a back side of the body shield. The plurality of horizontal straps is configured to enable a user of the body shield to maneuver the body shield on a human arm of the user to shield against a physical attack.

The plurality of horizontal straps includes an upper strap, a middle strap, and a lower strap. The upper strap is anchored at a top end of the back side of the body shield that can optionally connect with a hand grip affixed on an upper top of the body shield through a fastener. The middle strap enables the user to securely hold the body shield in a middle of a forearm of the user. The lower strap comfortably affixes near an elbow of the user to provide secure rotation of the body shield while minimizing the chance of the body shield falling off from the human arm of the user.

A high-modulus polyethylene material may form a front side of the body shield, to provide protection from sharp object penetration. A diagonal strap may be affixed at the back side of the body shield to enable the user to carry the body shield and items stored in the cavity on a human back. The diagonal strap may be detachably affixed at the back side of the body shield using a hook and loop fastener, a button fastener, a buckle fastener, and/or an interlocking clasp fastener.

The diagonal strap may be removably covered using a shoulder pad. The shoulder pad may include a concealed pouch to hold a heavy object, a metal, and/or a valuable item. The shoulder pad may be used to drive off an attacker by wielding the shoulder pad against the attacker.

The cavity formed in the interior portion of the body shield may be configured to receive an anti-stab board insert, an assault board insert, and/or a bulletproof protective board insert.

The upper strap may be at least 1 inch wide, the middle strap may be 1½ inches wide and the lower strap may be 2 inches wide for a 13 inches wide and 17 inches deep body shield.

The methods and systems disclosed herein may be implemented in any means for achieving various aspects, and may be executed in various forms, when executed by a machine, and causes the machine to perform any of the operations disclosed herein. Other features will be apparent from the accompanying drawings and from the detailed description that follows.

BRIEF DESCRIPTION OF THE DRAWINGS

The embodiments of this invention are illustrated by way of example and not limitation in the figures of the accompanying drawings, in which like references indicate similar elements and in which.

Figure 1A:
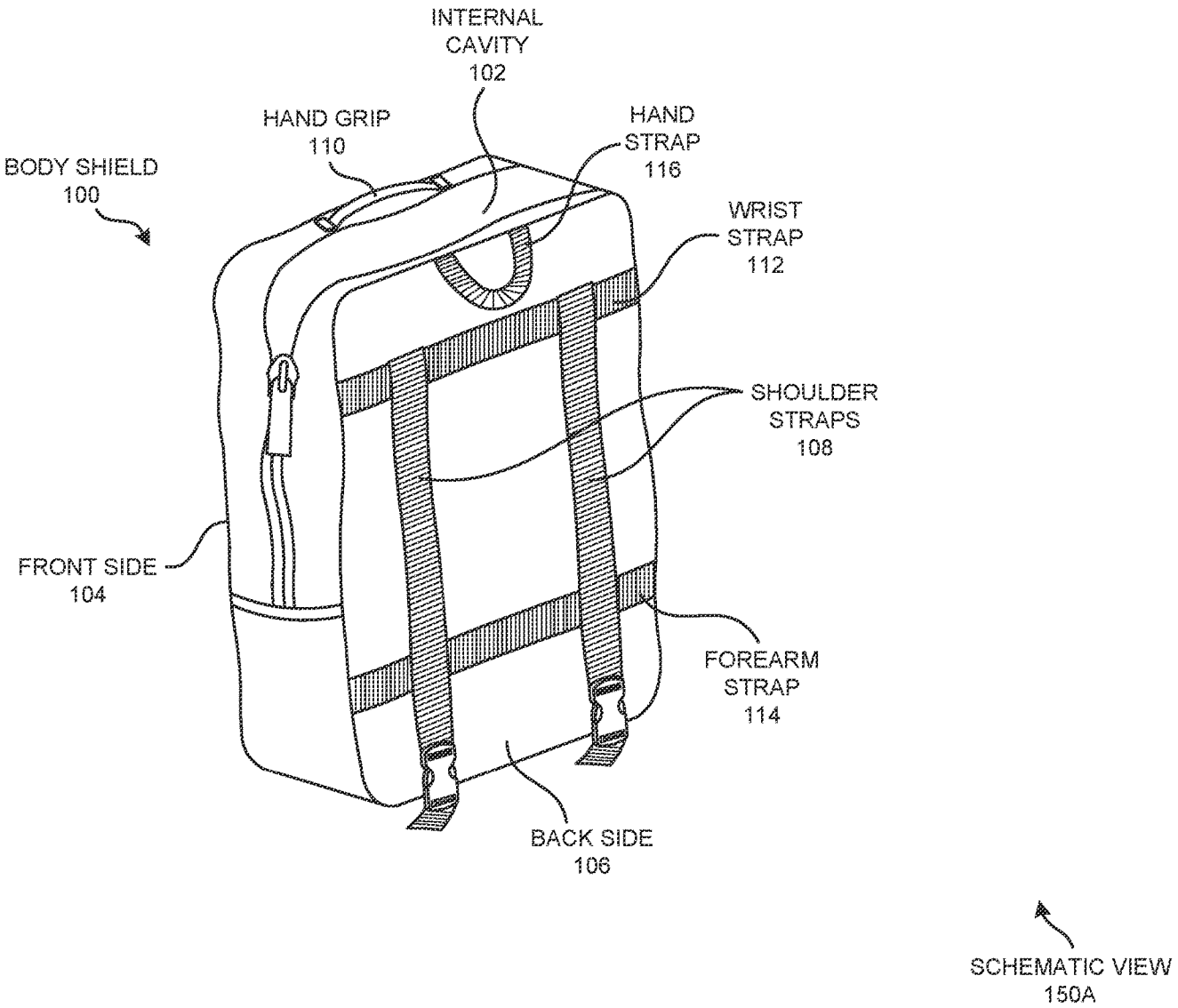
FIG. 1A is a schematic view of a body shield illustrating an exemplary formation of the rear perspective view of the body shield to provide protection against a sharp object penetration, according to one embodiment.

Other features of the present embodiments will be apparent from the accompanying drawings and from the detailed description that follows.

DETAILED DESCRIPTION

Example embodiments, as described below, may be used to provide a method of forming a body shield for providing protection against a sharp object penetration and/or a physical attack.

In one embodiment, a body shield 100 includes a cavity (e.g., internal cavity 102) formed in an interior portion of the body shield 100 in which items can be stored. In addition, the body shield 100 includes a plurality of horizontal straps affixed on a back side 106 of the body shield 100. The plurality of horizontal straps (e.g., hand strap 116, wrist strap 112, forearm strap 114) are configured to enable a user 304 of the body shield 100 to maneuver the body shield 100 on a human arm (e.g., forearm 204), to shield against a physical attack (e.g., as shown using direction of attack 308).

The plurality of horizontal straps may include an upper strap (e.g., hand strap 116), a middle strap (e.g., wrist strap 112), and a lower strap (e.g., forearm strap 114). The upper strap (e.g., hand strap 116) may be anchored at a top end of the back side 106 of the body shield 100 that may optionally connect with a hand grip 110 on an upper top of the body shield 100 through a fastener. The middle strap (e.g., wrist strap 112) may enable the user 304 to securely hold the body shield 100 in a middle of a forearm of the user 304. The lower strap (e.g., forearm strap 114) may comfortably affix near an elbow of the user 304 to provide secure rotation of the body shield 100 while minimizing the chance of the body shield 100 falling off from the human arm (e.g., forearm 204) of the user 304.

A pair of vertical straps (e.g., shoulder straps 108) may be affixed at the back side 106 of the body shield 100 to enable the user 304 to carry the body shield 100 and the items stored in the cavity (e.g., internal cavity 102) on a human back. The pair of vertical straps (e.g., shoulder straps 108) may be detachably affixed at the back side 106 of the body shield 100 using a hook and loop fastener, a button fastener, a buckle fastener, and/or an interlocking clasp fastener.

A high-modulus polyethylene material may form a front side 104 of the body shield 100, to provide protection from a sharp object penetration (e.g., bullet 502). The front side 104 of the body shield 100 may be configured to enable the user 304 to prevent grabbing, deflect the physical attack (e.g., as shown using direction of attack 308), and/or prevent theft.

The upper strap (e.g., hand strap 116) may be formed sturdier than the middle strap (e.g., wrist strap 112) and/or the lower strap (e.g., forearm strap 114) to enable a firm grip to hold the body shield 100. The upper strap (e.g., hand strap 116) may be wrapped with a hard foam-like material. The hand grip 110 may be configured to enable the user 304 to carry the body shield 100 with a single hand (e.g., hand 202).

The middle strap (e.g., wrist strap 112) may be situated approximately at a one-fourth of the distance from the top end of the back side 106 of the body shield 100 to enable the user 304 to securely hold the body shield 100 in the middle of the forearm 204 of the user 304 in the defensive position 306. The lower strap (e.g., forearm strap 114) may be situated approximately one-fourth of the distance from a bottom end of the back side 106 of the body shield 100. The lower strap (e.g., forearm strap 114) may be configured to enable the user 304 to rout his hand under the middle strap (e.g., wrist strap 112) to grasp the upper strap (e.g., hand strap 116) with hand to hold the body shield 100 in the defensive position 306.

At least one vertical strap of the pair of vertical straps (e.g., shoulder straps 108) may be removably covered with a shoulder pad (e.g., strap cover 404). The shoulder pad (e.g., strap cover 404) may include a concealed pouch (e.g., internal pouch 406) to hold a heavy object, a metal, and/or a valuable item. The shoulder pad (e.g., strap cover 404) may be used to drive off the attacker 302 by wielding the shoulder pad (e.g., strap cover 404) against an attacker 302.

The cavity (e.g., internal cavity 102) formed in the interior portion of the body shield 100 may be configured to receive an anti-stab board insert, an assault board insert, an anti-trauma pad, and/or a bulletproof protective board insert. The body shield 100 may be a backpack, a laptop carrier, an attaché case, a daypack, a tactical backpack, a sling bag, and/or a tote backpack.

In another embodiment, a method of fabricating a body shield 100 includes forming a cavity (e.g., internal cavity 102) in an interior portion of the body shield 100 to store a plurality of articles, and affixing a plurality of horizontal straps (e.g., hand strap 116, wrist strap 112, forearm strap 114) on a back portion (e.g., back side 106) of the body shield 100. The plurality of horizontal straps (e.g., hand strap 116, wrist strap 112, forearm strap 114) are configured to enable a user 304 of the body shield 100 to maneuver the body shield 100 on a human arm of the user 304, to shield against a physical attack (e.g., as shown using direction of attack 308).

The method may include anchoring an upper strap (e.g., hand strap 116) at a top end of the back portion of the body shield 100, anchoring a middle strap (e.g., wrist strap 112), and anchoring a lower strap (e.g., forearm strap 114). The upper strap (e.g., hand strap 116) may optionally connect with a hand grip 110 affixed on an upper top of the body shield 100 through a fastener. The middle strap (e.g., wrist strap 112) may enable the user 304 to securely hold the body shield 100 in a middle of a forearm 204 of the user 304. The lower strap (e.g., forearm strap 114) may comfortably affix near an elbow of the user 304 to provide secure rotation of the body shield 100 while minimizing the chance of the body shield 100 falling off from the human arm of the user 304.

The method may further include forming a front portion of the body shield 100 using a high-modulus polyethylene material to provide protection from a sharp object penetration. In addition, the method may include affixing a pair of vertical straps (e.g., shoulder straps 108) at a back portion of the body shield 100 to enable the user 304 to carry the body shield 100 and the articles stored in the cavity (e.g., internal cavity 102) on a human back. The pair of vertical straps (e.g., shoulder straps 108) may be detachably affixed at the back side 106 of the body shield 100 using a hook and loop fastener, a button fastener, a buckle fastener, and/or an interlocking clasp fastener.

Further, the method may include configuring the body shield 100 to function as a backpack, a laptop carrier, an attaché case, a daypack, a tactical backpack, a sling bag, and/or a tote backpack.

In addition, the method may include configuring the hand grip 110 on the upper top of the body shield 100 to enable the user 304 to carry the body shield 100 with a single hand 202. The method may include partitioning the cavity (e.g., internal cavity 102) at the interior portion of the body shield 100 to receive an anti-stab board insert, an assault board insert, and/or a bulletproof protective board insert (e.g., plurality of protective inserts).

Additionally, the method may include affixing the middle strap (e.g., wrist strap 112) approximately at a one-fourth of the distance from the top end of the back side 106 of body shield 100 to enable the user 304 to grasp the middle strap (e.g., wrist strap 112) with hand 202 to hold the body shield 100 in the defensive position 306, and affixing the lower strap (e.g., forearm strap 114) approximately one-fourth of the distance from the bottom end of the back side 106 of the body shield 100. The lower strap (e.g., forearm strap 114) may be configured to enable the user 304 to rout his hand 202 under the middle strap (e.g., wrist strap 112) to grasp the upper strap (e.g., hand strap 116) with hand 202 to hold the body shield 100 in the defensive position 306.

Further, the method may include configuring the body shield 100 to enable the user 304 to manipulatively rotate the body shield 100 in all the directions in 360 degrees, with the body shield 100 affixed onto the human arm of the user 304 in a defensive position 306, depending on a direction of attack 308.

In yet another embodiment, a body shield 100 includes a cavity (e.g., internal cavity 102) formed in an interior portion of the body shield 100 in which items can be stored and a plurality of horizontal straps (e.g., hand strap 116, wrist strap 112, forearm strap 114) affixed on a back side 106 of the body shield 100. The plurality of horizontal straps (e.g., hand strap 116, wrist strap 112, forearm strap 114) are configured to enable a user 304 of the body shield 100 to maneuver the body shield 100 on a human arm of the user 304 to shield against a physical attack (e.g., as shown using direction of attack 308).

The plurality of horizontal straps includes an upper strap (e.g., hand strap 116), a middle strap (e.g., wrist strap 112), and a lower strap (e.g., forearm strap 114). The upper strap (e.g., hand strap 116) is anchored at a top end of the back side 106, of the body shield 100 that can optionally connect with the hand grip 110 affixed on an upper top of the body shield 100, through a fastener.

The middle strap (e.g., wrist strap 112) enables the user 304 to securely hold the body shield 100 in a middle of a forearm 204 of the user 304. The lower strap (e.g., forearm strap 114) comfortably affixes near an elbow of the user 304 to provide secure rotation of the body shield 100 while minimizing the chance of the body shield 100 falling off from the human arm of the user 304.

A high-modulus polyethylene material may form a front side 104 of the body shield 100, to provide protection from sharp object penetration. A diagonal strap 402 may be affixed at the back side 106 of the body shield 100 to enable the user 304 to carry the body shield 100 and items stored in the cavity (e.g., internal cavity 102) on a human back. The diagonal strap 402 may be detachably affixed at the back side 106 of the body shield 100 using a hook and loop fastener, a button fastener, a buckle fastener, and/or an interlocking clasp fastener.

The diagonal strap 402 may be removably covered using a shoulder pad (e.g., strap cover 404). The shoulder pad (e.g., strap cover 404) may include a concealed pouch (e.g., internal pouch 406) to hold a heavy object, a metal, and/or a valuable item. The shoulder pad (e.g., strap cover 404) may be used to drive off an attacker 302 by wielding the shoulder pad (e.g., strap cover 404) against the attacker 302. The hand grip 110 on the upper top of the body shield 100 may enable the user 304 to carry the body shield 100 with a single hand 202.

The cavity (e.g., internal cavity 102) formed in the interior portion of the body shield 100 may be configured to receive an anti-stab board insert, an assault board insert, and/or a bulletproof protective board insert (e.g., plurality of protective inserts 118).

The upper strap (e.g., hand strap 116) may be at least 1 inch wide, the middle strap (e.g., wrist strap 112) may be 1½ inches wide and the lower strap (e.g., forearm strap 114) may be 2 inches wide for a 13 inches wide and 17 inches deep body shield 100.

FIG. 1A is a schematic view 150A of a body shield 100 illustrating an exemplary formation of the rear perspective view of the body shield 100 to provide protection against a sharp object penetration, according to one embodiment. Particularly, FIG. 1A illustrates an internal cavity 102, a front side 104, a back side 106, a pair of shoulder straps 108, a hand grip 110, a wrist strap 112, a forearm strap 114, and a hand strap 116.

The internal cavity 102 may be a hollow chamber formed at the inner section of the body shield 100, between the front side 104 and the back side 106. A number of items (e.g., clothing, books, electronics, computer, plurality of protective inserts 118 etc.) can be stored in the internal cavity 102 of the body shield 100. The internal cavity 102 may be partitioned to a number of compartments to hold a plurality of protective inserts 118, according to one embodiment.

The front side 104 may be an anterior section of the body shield 100. The front side 104 of the body shield 100 may be formed using a cut resistant material to provide safety and security to its user 304. The front side 104 may be formed to have a smooth outer surface, and may be devoid of any pockets and/or straps. The smooth front side 104, in the absence of any pockets and/or straps, may enable a user 304 to prevent an attacker 302 from grabbing the body shield 100 from front, according to one embodiment.

A heavy-duty, cut resistant aramid fiber fabric may be used to make the front panel (e.g., front side 104) of the body shield 100. The use of the heavy-duty, aramid fiber fabric may prevent sharp objects (e.g., a bullet, firearm, a knife, a shrapnel etc.) from penetrating the body shield 100. Further, the front side 104 of the body shield 100 may have high strength due to relatively rigid polymer chains of the aramid fiber with a high melting point, making the body shield 100 lightweight and tough to counter an attacking situation, according to one embodiment.

In another embodiment, an ultra-high-molecular-weight polyethylene (e.g., UHMWPE, UHMW) material may be used to make the front panel (e.g., front side 104) of the body shield 100. The front side 104 of the body shield 100 may be designed to have high impact and abrasion strength by using ultra-high-molecular-weight polyethylene (e.g., UHMWPE, UHMW) material to make the front panel (e.g., front side 104). In addition, the front side 104 may be resistant to acid and/or alkali attack due to use of the ultra-high-molecular-weight polyethylene (e.g., UHMWPE, UHMW) material, according to one embodiment.

The back side 106 may be the rear portion of the body shield 100. The back side 106 may form the base to secure the unique configuration of the webbing straps (e.g., pair of vertical straps, plurality of horizontal straps, shoulder strap 108, wrist strap 112, forearm strap 114, hand strap 116 and diagonal strap 402), of the body shield 100. A covered, heavy duty zipper may hold the front half (e.g., front side 104) and rear half (e.g., back side 106) of the body shield 100 together, according to one embodiment.

The shoulder straps 108 (e.g., pair of vertical straps) may be a set of belts running vertically across the back side 106 of the body shield 100. The pair of shoulder straps 108 may be designed to enable the body shield 100 to be carried on the back of the user 304. The pair of shoulder straps 108 may be adjustable to help correctly position the body shield 100 on the back. The pair of shoulder straps 108 may be straight, curved, and/or one-piece shoulder strap, according to one embodiment.

The hand grip 110 may be a strap loop provided at the top portion of the body shield 100 to hold the body shield 100 with a single hand (e.g., hand 202) to carry the body shield 100. The hand grip 110 may be covered with a piece of hard foam to provide a firm grip to hold the body shield 100 with a single hand. The hard foam around the hand grip 110 may allow the user to have more leverage to hold the body shield 100. The hand grip 110 may enable a strong grip on the body shield 100 with one hand (e.g., hand 202) while holding the body shield 100 with another hand, to tackle the hostile assault. The user 304 may prevent a hostile assault from the attacker 302 by blocking an attempt to stab and/or blow, by pushing the body shield 100 towards the attacker 302, according to one embodiment.

In an additional embodiment, the body shield 100 may be locked at the top portion by fastening the hand grip 110 and the hand strap 116 together to prevent theft.

The wrist strap 112 may be the middle strap of the body shield 100 running horizontally underneath the pair of shoulder straps 108. The wrist strap 112 may be affixed approximately at a one-fourth of the distance from the top end at the back side 106 of body shield 100. The wrist strap 112 may be configured to enable the user 304 to easily slip its hand 202 under the forearm strap 114 and grasp the wrist strap 112, to securely hold the body shield 100 in a middle of a forearm 204, according to one embodiment.

In another embodiment, wrist strap 112 may be secured at approximately 4 inches from the top end of the body shield 100 for a 17 inches deep body shield 100.

The forearm strap 114 may be the lower strap of the body shield 100 running horizontally underneath the pair of shoulder straps 108. The forearm strap 114 may be affixed approximately at a one-fourth of the distance from the bottom end at the back side 106 of body shield 100. The forearm strap 114 may be configured to enable the user 304 to easily rout its hand 202 under the forearm strap 112 to grab the hand strap 116 and the wrist strap 112, and securely position the body shield 100 in the middle of the forearm 204, according to one embodiment.

The forearm strap 114, hand strap 116 and the wrist strap 112 may be configured to securely position the body shield 100 onto the user's forearm 204 such that it does not displace and/or fall off from its position even when the user 304 rotates his hand 202 in all the directions in 360 degrees, depending on a direction of attack 308.

The hand strap 116 may be an upper strap provided at the top end of the back side 106 of body shield 100. The hand strap 116 (e.g., upper strap) may be wrapped with a hard foam-like material. The hand strap 116 may ensure a firm grip for the user 304 to hold the body shield 100, according to one embodiment.

The shoulder straps 108, the wrist strap 112, the hand strap 116, the hand grip 110, and the forearm strap 114 may be strategically positioned on the body shield 100 such that it provides a firm grip and easy maneuverability to the user 304 to protect against a physical attack. The pair of vertical straps (e.g., shoulder straps 108) prevents the body shield 100 from slipping away from its position while the user 304 rotates the body shield 100 towards the attacker to protect himself, according to one embodiment.

The body shield 100 may be made of 1000 denier cordura material to make it durable, tear resistant, and heavy duty. The straps may be made of military grade nylon webbing to withstand rugged handling. The lightweight body shield 100 along with its uniquely designed strap webbing (e.g., shoulder straps 108, wrist strap 112, hand strap 116, forearm strap 114 and diagonal strap 402) may enable the user 304 to use it as a tactical assault protection and combat tool. A triple reinforced stitching may be used to stitch the body shield 100 to make it sturdy, according to one embodiment.

Figure 1B:
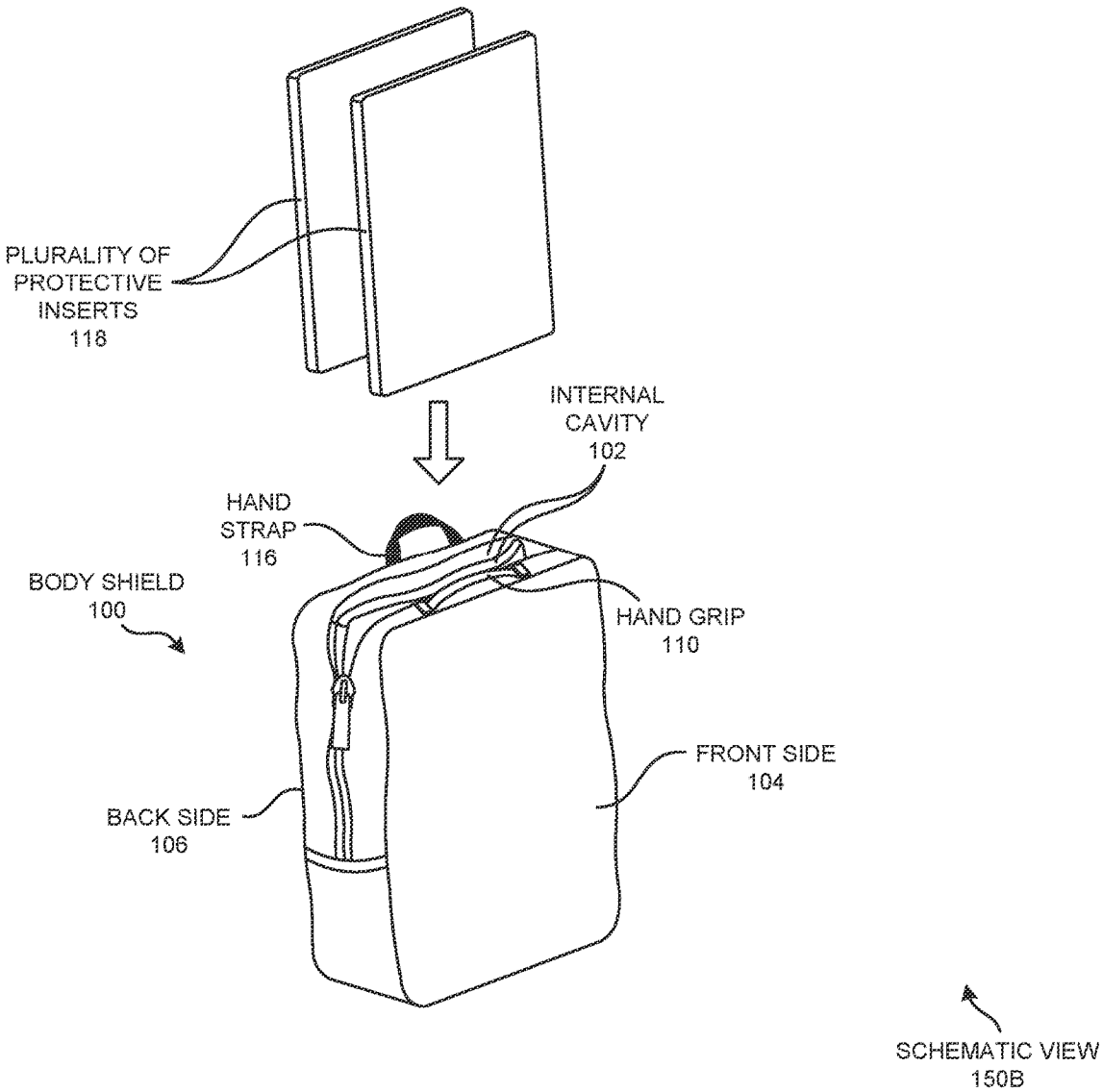
FIG. 1B is another schematic view of the body shield of FIG. 1A illustrating an exemplary formation of the front perspective view of the body shield in which a plurality of protective inserts may be installed in the internal cavity of the body shield, according to one embodiment.

FIG. 1B is another schematic view 150B of the body shield 100 of FIG. 1A illustrating an exemplary formation of the front perspective view of the body shield 100 in which a plurality of protective inserts 118 may be installed in the internal cavity 102 of the body shield 100, according to one embodiment. Particularly, FIG. 1B builds on FIG. 1A, and further adds, plurality of protective inserts 118. As shown in the figure, the front side 104 of the body shield 100 may be configured such that it is devoid of any pocket and/or straps. The smooth formation of the front side 104 of the body shield 100 prevents anyone (e.g., an attacker 302) from grabbing and/or snatching the body shield 100 belligerently from behind. Thus, the user 304 may be able to defend himself from such a sudden attack. In addition, the smooth formation of the front side 104 of the body shield 100 may help blocking and/or averting the physical attack. The absence of pockets and/or straps in the front side 104 of the body shield 100 may help prevent a possible theft and/or snatching of the body shield 100, according to one embodiment.

In one embodiment, the front side 104 of the body shield 100 may be made of a slash-proof Ultra-High-Molecular-Weight Polyethylene material to make it bulletproof and/or penetration proof.

The internal cavity 102 of the body shield 100 may be partitioned to a number of compartments to hold a plurality of protective inserts 118. The plurality of protective inserts 118 may be an anti-stab board insert, an assault board insert, an anti-trauma pad insert, and a bulletproof protective board insert (e.g., ceramic plate backed by multiple layers of a non-woven fabric film), according to one embodiment. In addition, the plurality of protective inserts 118 may include an anti-static board.

In one embodiment, the anti-trauma pad insert (e.g., plurality of protective inserts 118) may protect the user 304 from a blunt force trauma. The anti-stab board insert may protect the user 304 from any sort of edge weapon and/or any sort of bludgeon weapon. In addition, the anti-trauma pad insert (e.g., protective inserts 118) of the body shield 100 may protect the user if the attacker tries to punch and/or kick the user 304.

Figure 2:
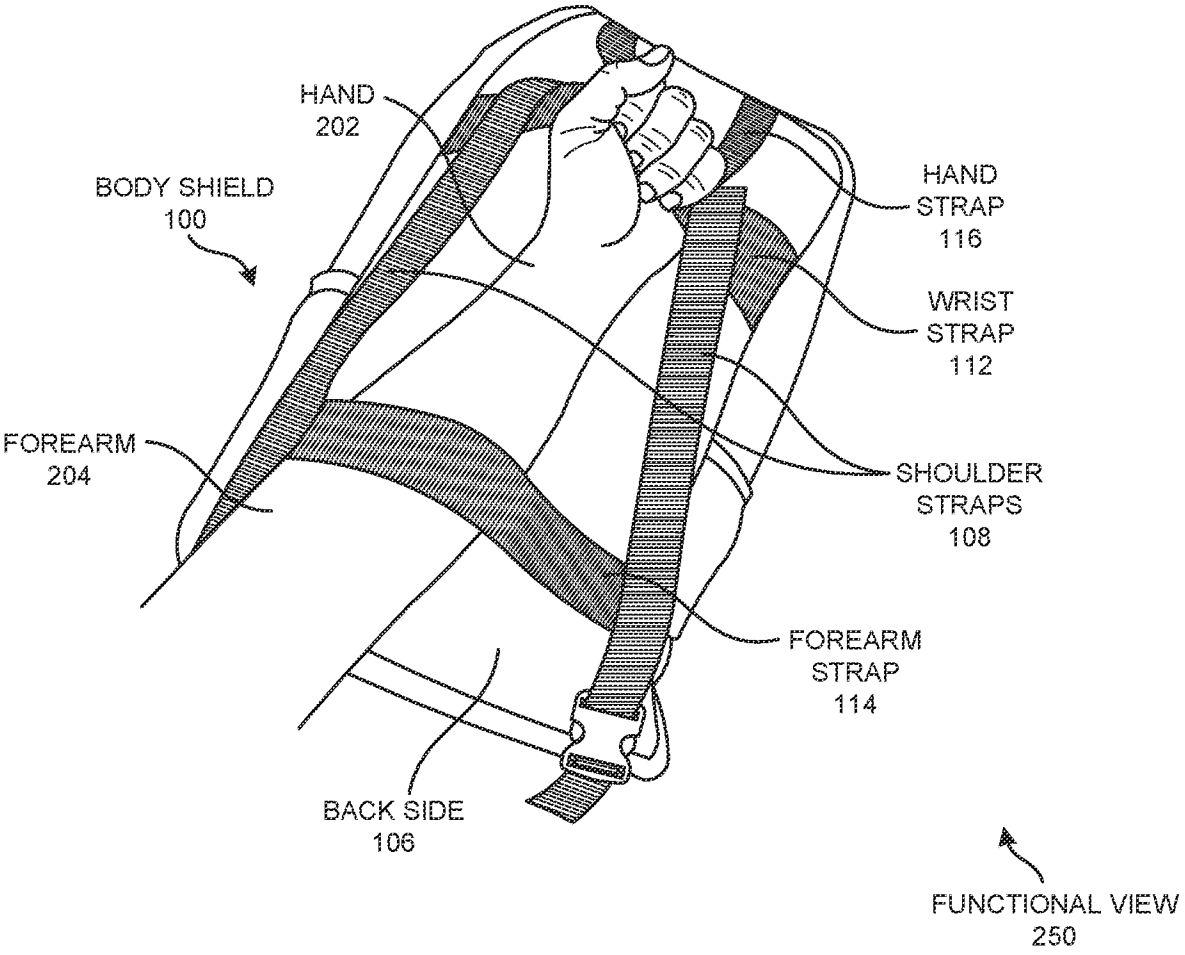
FIG. 2 is a functional view of the body shield of FIG. 1A illustrating the body shield secured on a user's arm to be used in a defensive position, according to one embodiment.

FIG. 2 is a functional view 250 of the body shield 100 of FIG. 1A illustrating the body shield 100 securely positioned on a user's forearm 204 to be used in a defensive position 306, according to one embodiment. Particularly, FIG. 2 illustrates the unique strap configuration that allows the user 304 to quickly rout its hand 202 under the lower forearm strap 114 to grab the middle wrist strap 112 and upper hand strap 116 to hold the body shield 100. The unique strap configuration of the vertical straps (e.g., shoulder straps 108) and horizontal straps (e.g., forearm strap 114, wrist strap 112, and hand strap 116) may prevent the horizontal movement of the hand across the lower forearm strap 114 and provide an absolute control of the body shield 100, so that the user 304 may easily maneuver and rotate his hand with body shield 100 on it, towards the attacker 302, without falling off from the user's hand 202, according to one embodiment.

The user 304 may defend himself against the physical attack using the body shield 100. The unique strap configuration with strategically positioned horizontal straps (e.g., wrist strap 112, hand strap 116, and forearm strap 114) and vertical straps (e.g., shoulder straps 108) further allows easy maneuverability as a defensive shield against the physical attack (e.g., as shown in direction of attack 308). The strategic locations of the horizontal straps (e.g., wrist strap 112, hand strap 116, and forearm strap 114) may be designed such that it firmly secures the body shield 100 onto the user's hand. The strategically positioned horizontal straps (e.g., wrist strap 112, hand strap 116, and forearm strap 114) and vertical straps (e.g., shoulder straps 108) allows the user to stabilize the body shield 100 on his hand 202 to optimally utilize the body shield 100, according to one embodiment.

The body shield 100 may be made lightweight for easy maneuverability. The user 304 may be able to easily lift and move the body shield 100 to protect himself. The body shield 100 may be made of 1000 denier cordura material to make it lightweight and heavy-duty bulletproof. The straps may be heavy canvas using military grade nylon webbing. A triple reinforced stitching may be used to provide stronger seam in the body shield 100. The body shield 100 may be designed to resist an attacker 302 and get out of a life-threatening situation, according to one embodiment.

Figure 3:
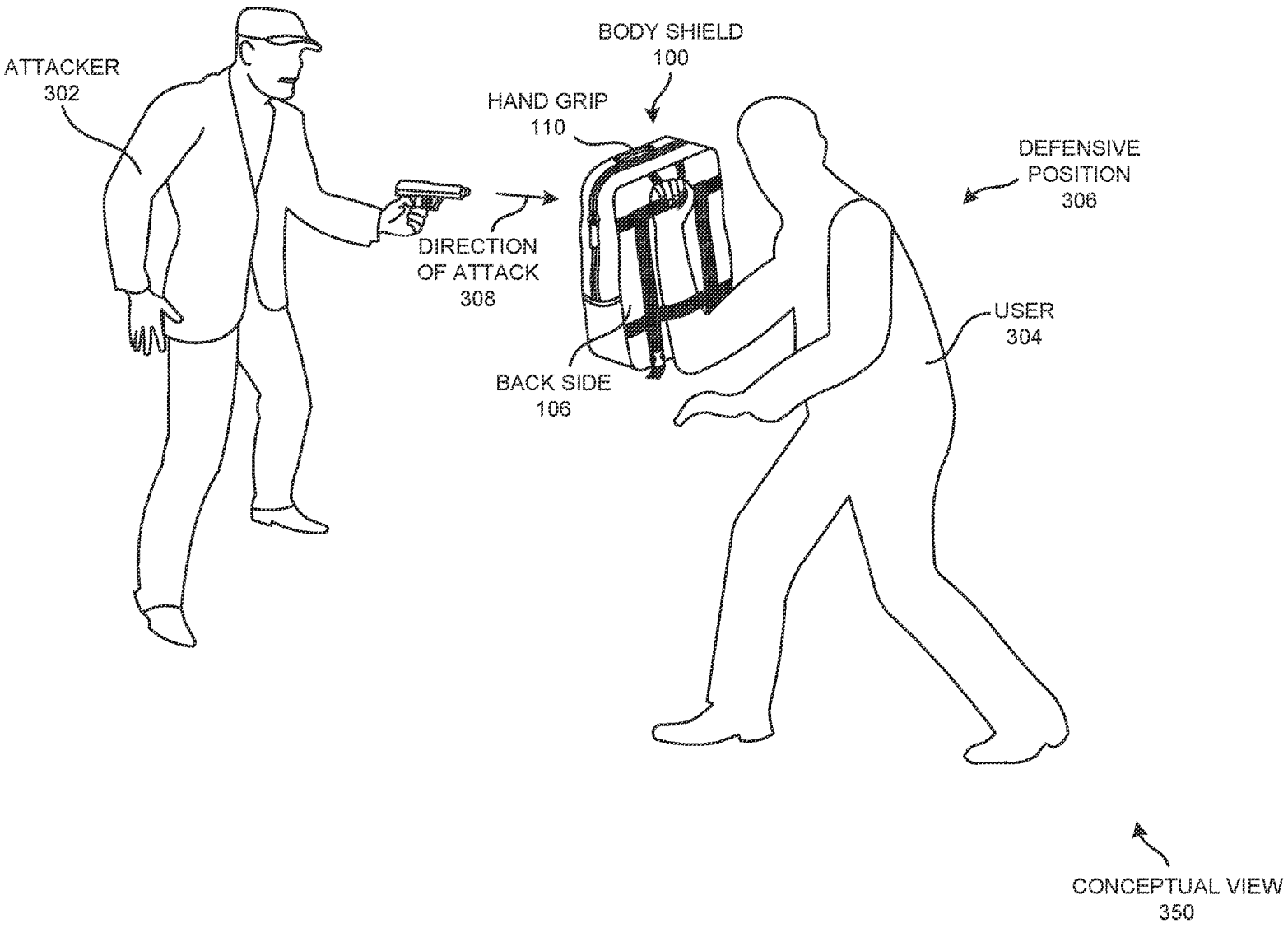
FIG. 3 is a conceptual view of the body shield of FIG. 1A illustrating the body shield securely positioned on a user's forearm to be used for personal protection against a physical attack, according to one embodiment.

FIG. 3 is a conceptual view of the body shield 100 of FIG. 1A illustrating the body shield 100 securely positioned on a user's forearm 204 to be used for personal protection against a physical attack, according to one embodiment. Particularly, FIG. 3 illustrates an example embodiment of the body shield 100 of FIG. 1A securely held by the user 304 in a defensive position 306. The user 304 may defend himself by holding the body shield 100 in the front, blocking the attack by placing the front side 104 towards the attacker 304. The user 304 may securely position the body shield 100 on his forearm 204 as soon as he comes under a physical attack.

Figure 7:
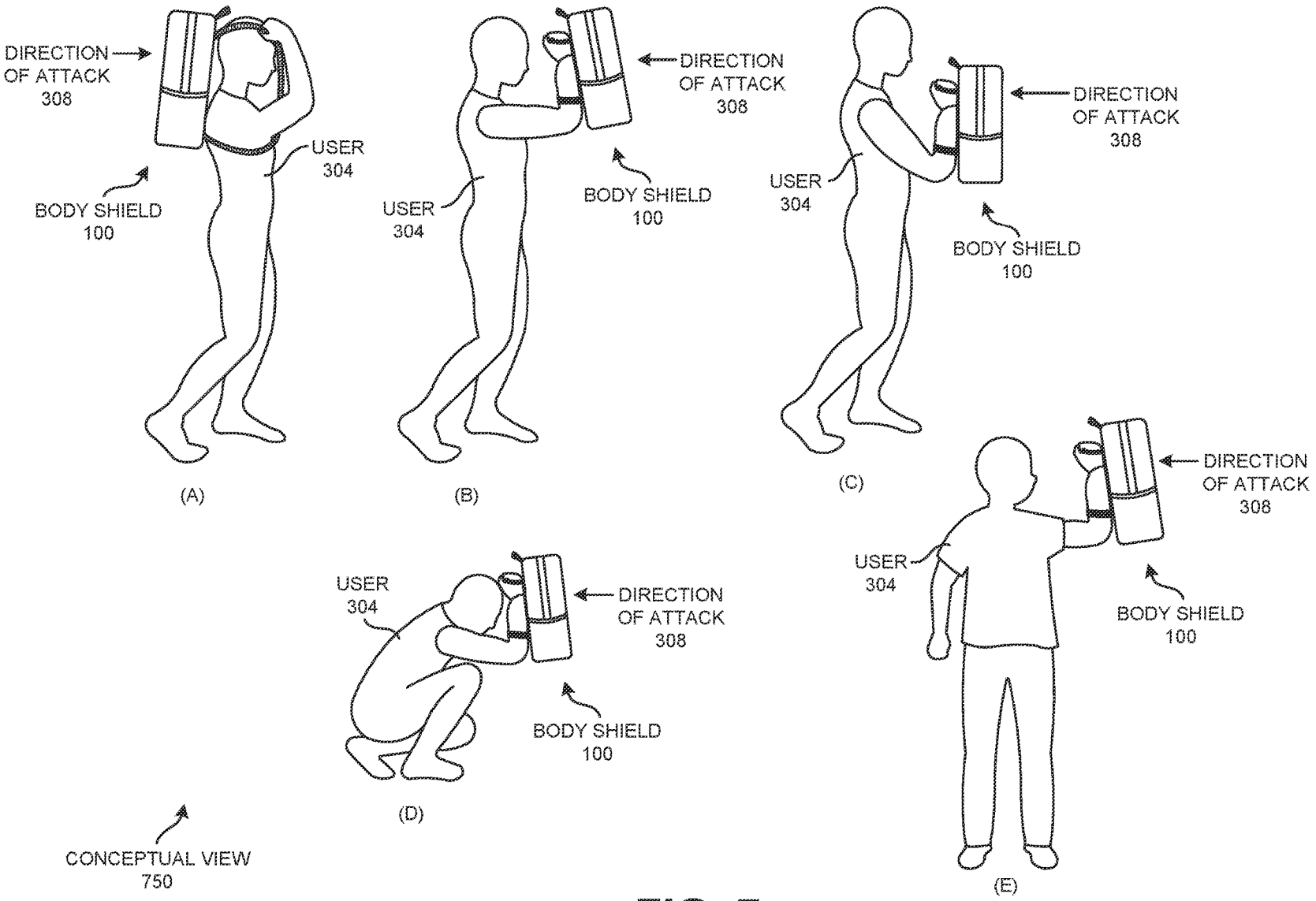
FIG. 7 is a conceptual view of the body shield of FIG. 1A illustrating the various exemplary positions the body shield may be placed to save oneself from physical attacks, according to one embodiment.

The plurality of protective inserts 118 of the body shield 100 may be able to protect the user 304 from any sharp object penetration (e.g., a gunshot, a knife attack). The unique strap configuration of the body shield 100 may allow the user 304 to easily maneuver the body shield 100 and position it depending upon the direction of the threat (e.g., as shown using direction of attack 308 in FIG. 7) that is coming towards him, to defend himself. The user 304 may relatively move and position the body shield 100 (e.g., over the head, chest, front of the torso, back of the torso, at the left and/or right side as shown in FIG. 7), depending upon the direction of the threat, and where it is coming from. The user may be able to rotate the body shield 100 installed on his hand, in all the directions in 360 degrees, depending on the direction of attack 308. Maneuvering and relatively positioning the body shield 100 may not require any kind of specific training to prevent the physical attack because of a lightweight construction of the body shield 100 and strategically placed strap configuration of the body shield 100, according to one embodiment.

The unique strap configuration of the body shield 100 allows the user 304 to hold the body shield 100 with one hand 202, while the other hand remains free for the user 304 to offensively defend himself against the attacker 302. The strategically designed strap configuration of the body shield 100 allows the user 304 to comfortably affix the body shield 100 near the elbow such that it does not get removed and/or displaced from its position, and provides secure rotation of the body shield 100. The unique strap configuration of the body shield 100 may also reduce the chances of the body shield 100 from falling off from the forearm 204 of the user 304 while defending himself, according to one embodiment.

Figure 4:
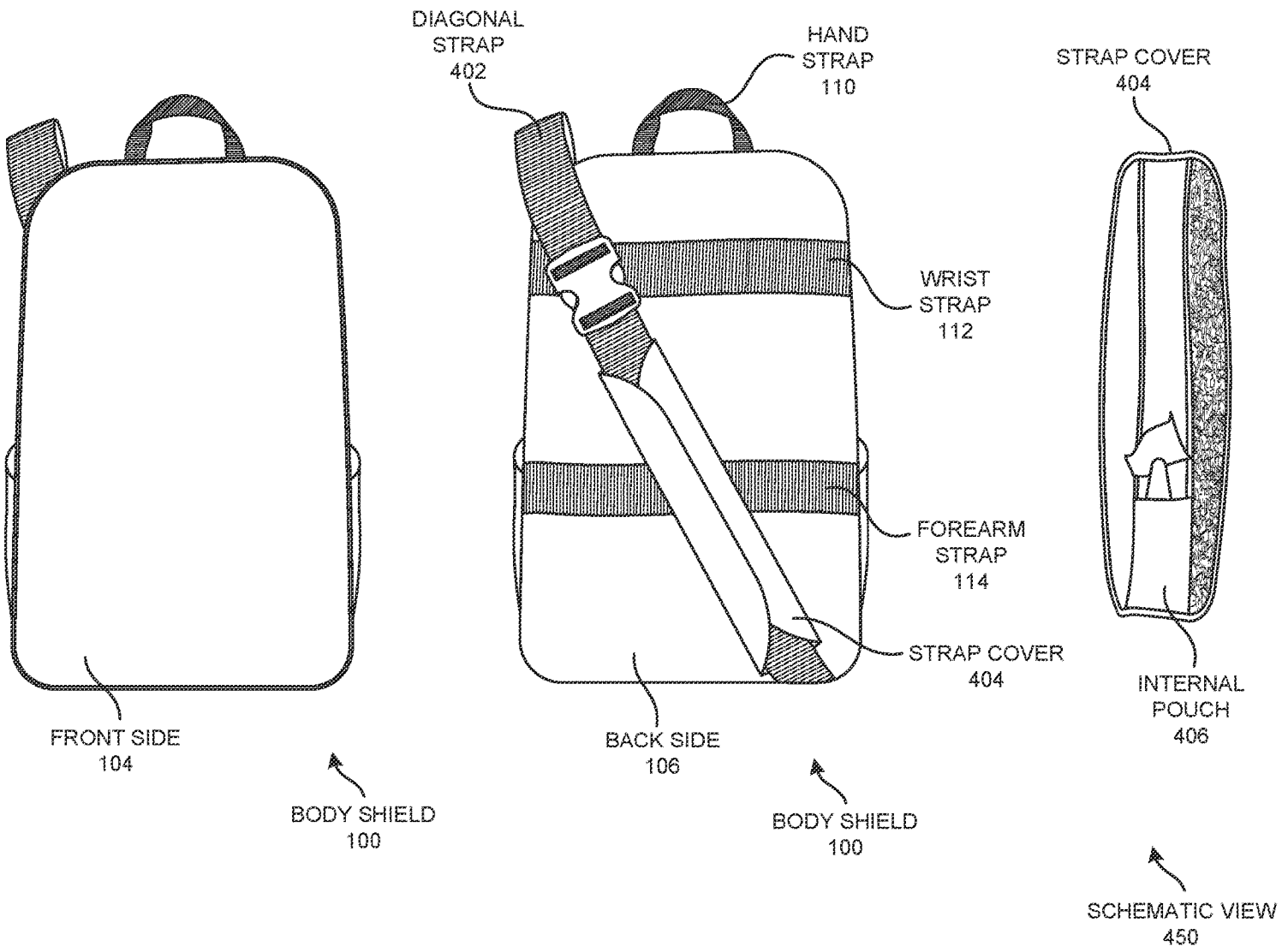
FIG. 4 is another schematic view of the body shield of FIG. 1A illustrating an additional exemplary formation of the body shield using a diagonal strap configuration, according to one embodiment.

FIG. 4 is another schematic view 450 of the body shield 100 of FIG. 1A illustrating an additional exemplary formation of the body shield 100 using a diagonal strap 402 configuration, according to one embodiment. Particularly, FIG. 4 builds on FIGS. 1A-3, and further adds, a diagonal strap 402, a strap cover 404, and an internal pouch 406.

The diagonal strap 402 may be an angled strap positioned obliquely at the back side 106 of the body shield 100. The diagonal strap 402 may enable the user 304 to position the body shield 100 as a sling bag on its shoulder. The diagonal strap 402 (e.g., shoulder strap 108) may be enveloped with a strap cover 404 that may be removed, as required. This strap cover 404 may be removably secured onto the diagonal strap 402 with a hook and loop fastener (e.g., a Velcro fastener). This strap cover 404 may have a concealed pouch (e.g., internal pouch 406) at one of its ends to hold an article (e.g., heavy object, metal, valuable item, medal, coins, etc.) in it. When confronting a hostile situation, the user 304 may remove the strap cover 404 from the diagonal strap 402 and wield it against the attacker 302 to drive him off. The extreme end of the strap cover 404 having the internal pouch 406 may hold a heavy object to make it a striking weapon (e.g., a blackjack) against the attacker 302. The strap cover 404 may be designed so as to be quickly removed (e.g., using velcro) from the diagonal strap 402 and deliver a ferocious impact on the attacker 302 using the strap cover 404 containing the heavy object in its internal pouch 406, according to one embodiment.

Figure 5:
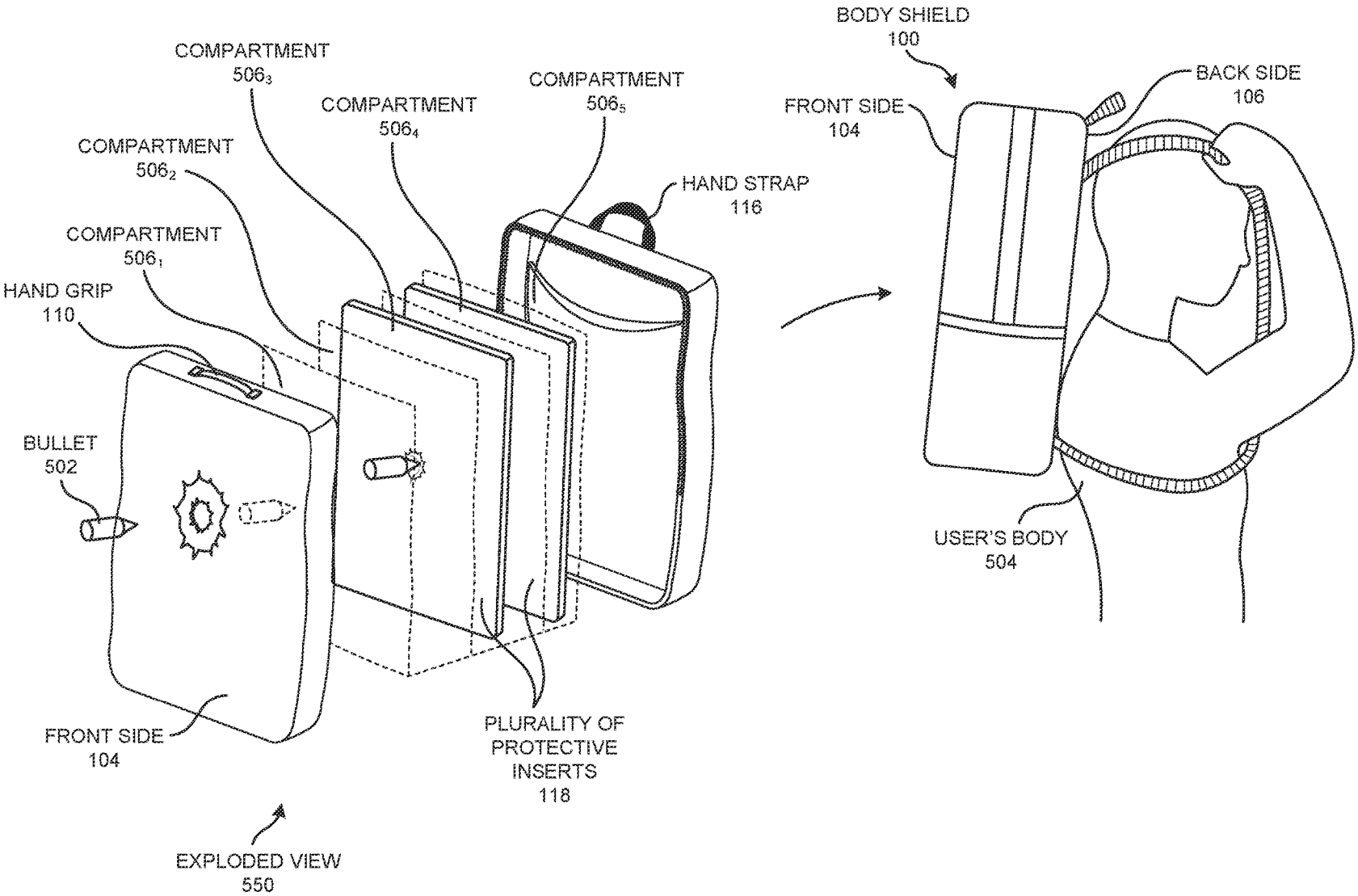
FIG. 5 is an exploded view of the body shield of FIG. 1A illustrating the order of assembly of various components of the body shield, according to one embodiment.

FIG. 5 is an exploded view 550 of the body shield 100 of FIG. 1A illustrating the order of assembly of various components of the body shield 100, according to one embodiment. Particularly, FIG. 5 illustrates the unique arrangement in which the body shield 100 may be configured. The heavy-duty, cut resistant front side 104 of the body shield 100 may be positioned away from the user's body 504, such that the front side 104 first comes in contact with the physical attack (e.g., sharp object penetration). The back side 106 of the body shield 100 may be positioned near the user's body 504 such that the back side 106 remains in contact with the user 304. The unique placement of the front side 104 and the back side 106 of the body shield 100 may help reduce the impact of the physical attack. The plurality of protective inserts 118 placed in the internal cavity 102 may further help reduce the impact of the physical attack (e.g., sharp object penetration, bullet, etc.) by reducing its speed and/or penetration. The impact of the physical attack may diminishingly reduce by the time it reaches the user's body 504, leading to a minimal or no injury to the user 304, according to one embodiment.

In FIG. 5, the interior of the body shield 100 and the plurality of protective inserts 118 are shown according to one embodiment. The interior (e.g., internal cavity 102) may be equipped with a total protection system protecting the user 304 from a wide array of attacks. As seen in FIG. 5, the interior of the body shield 100 of the present invention includes a number of compartments $\mathbf{506}_{1\text{-}5}$ that are specifically configured to receive the unique protective inserts of the present invention. For example, as seen in FIG. 5, compartment $\mathbf{506}_1$ may receive an anti-stab and/or assault board insert while compartment $\mathbf{506}_2$ may receive a bulletproof protective insert. Middle compartment $\mathbf{506}_3$ may preferably be a storage compartment. Compartment $\mathbf{506}_4$ may also receive a bulletproof protective insert while compartment $\mathbf{506}_5$ may receive a blunt force trauma pad protective insert. Thus, each compartment may serve its own purpose. Compartment $\mathbf{506}_1$ may be intended for an anti-stab board and/or anti assault board. The body shield 100 may be loaded and/or custom configured to serve the protective needs of the user 304 based on threat level and location, according to one embodiment.

In another embodiment, the plurality of protective inserts 118 and its placement in the internal cavity 102 of the body shield 100 may be interchangeable depending upon the threat level and location.

According to one embodiment, the internal cavity 102 of the body shield 100 may have five different compartments that are configured to receive plurality of protective inserts 118 interchangeably, depending upon how the user 304 may want to carry the body shield 100. The anti-trauma pad may be placed at the back side 106, closest to the user's body 504, to stop the energy of a bullet when it hits the ballistic insert from causing any internal damage to the user's body 504. The bulletproof insert of the protective inserts 118 may prevent the bullet from going through it, but indentation may go through the user's body 504 to cause an internal damage. This may be prevented by placing the anti-trauma pad at the back side 106, closest to the user's body 504. The anti-trauma pad may be used to disperse the energy of the penetrating bullet from impacting the user's body 504. Thus, the anti-trauma pad of the body shield 100 may prevent an internal injury to the user's body 504 from a bullet and/or shrapnel.

Figure 6:
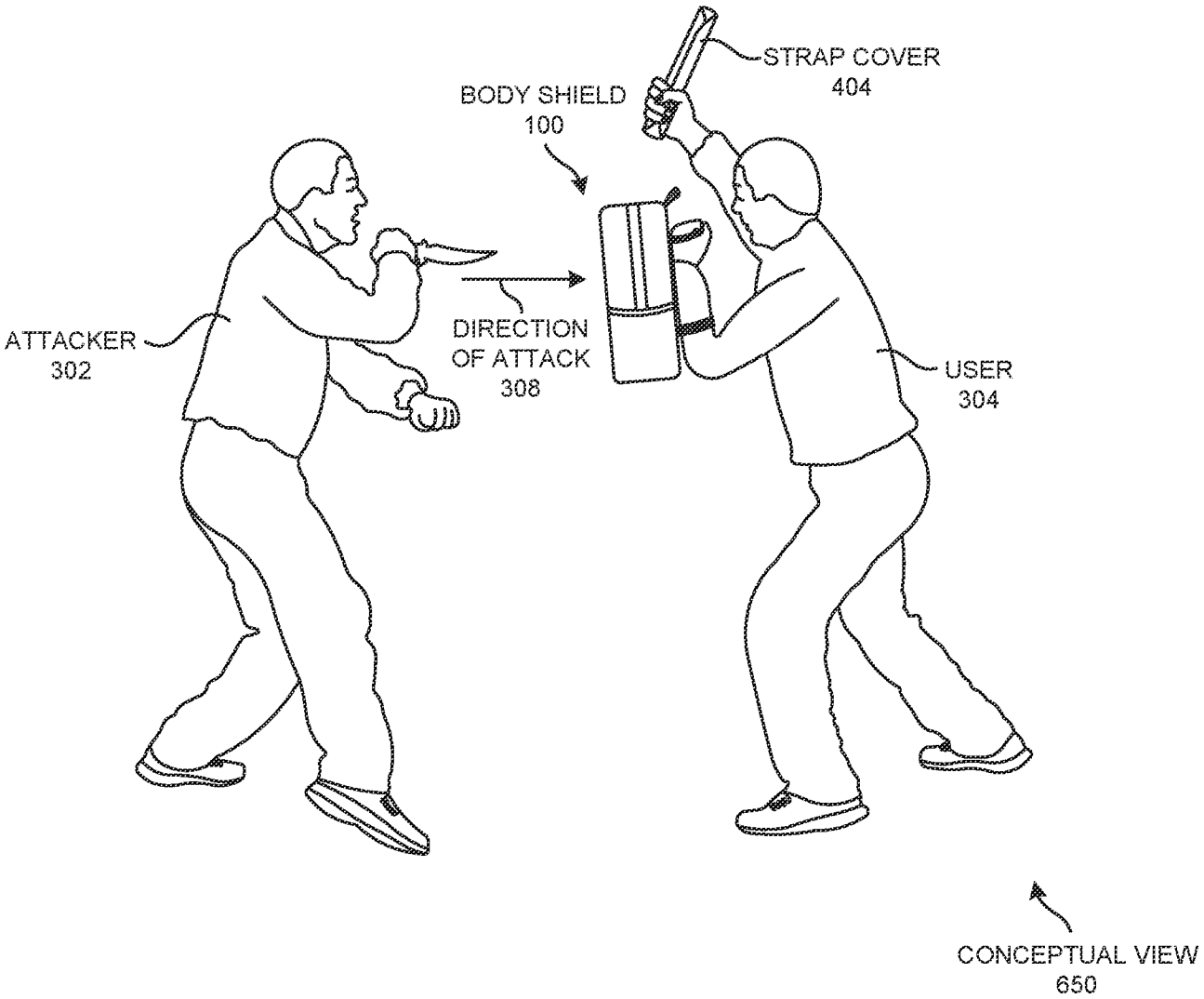
FIG. 6 is a conceptual view of the body shield of FIG. 1A illustrating the body shield being used as a shield and to drive off the attacker by wielding the strap cover against the attacker, according to one embodiment.

FIG. 6 is a conceptual view 650 of the body shield 100 of FIG. 1A illustrating the body shield 100 being used as a shield and wielding the strap cover 404 against the attacker 302 to drive him off, according to one embodiment. Particularly, FIG. 6 illustrates a user 304 defending himself against a physical attack using the body shield 100. As soon as the user 304 gets in a hostile situation, the user 304 may quickly affix the body shield 100 in one of his arms and place the body shield 100 towards the attacker 302, to shield himself. Further, the user 304 may remove the strap cover 404 from the shoulder strap 108 and wield it against the attacker 302 to drive him off, saving himself from a violent physical attack, according to one embodiment.

FIG. 7 is a conceptual view 750 of the body shield 100 of FIG. 1A illustrating the exemplary embodiment of various positions the body shield 100 may be placed to save oneself from physical attacks. As shown in "(A)" of FIG. 7, the user 304 may hold the body shield 100 at the back of his head to protect his shoulders, head and neck portion, if he is attacked from behind, in his upper body portion. The lightweight construction of the body shield 100 may enable the user 304 to swiftly remove the body shield 100 from his shoulders and affix it onto his forearm, as described in the various embodiments of FIGS. 1A-6. As shown in "(B)" of FIG. 7, the user 304 may protect his upper body portions (e.g., shoulders, head and neck) if he is attacked from the front. The user 304 may again place the body shield 100 at the front to protect his torso shown in "(C)" of FIG. 7. The user 304 may further use the body shield 100 to protect himself against the physical attack in a sitting position shown in "(D)" of FIG. 7. Further, the user 304 may block the physical attack coming from the left or right side by relatively positioning the body shield 100 in the direction of the attack 308 as shown in "(E)" of FIG. 7.

As described in the various embodiments of FIGS. 1A-6, the user 304 may manipulatively rotate the body shield 100 in all the directions, in 360 degrees, to protect himself against the physical attack depending on the direction of attack 308 with the body shield 100 affixed onto his am (e.g., forearm 204) in a defensive position 306.

The body shield 100 of the present invention may provide protection against a multitude of threats and physical attacks. The body shield 100 may be outfitted with cut resistant material (e.g., Ultra-High-Molecular-Weight Polyethylene, Aramid composite fabric, high-modulus polyethylene material, etc.) for safety and security. For example, the body shield 100 may preferably have a 13 inch width and a 17 inch height, but the dimensions of the body shield 100 may be varied based on the body frame of the user 304 (e.g., kid, woman, adolescent, man, etc.). The variation of the dimensions and relative positioning of strap webbing of the body shield 100 may be employed in accordance with the present invention, as described in various embodiments of FIG. 1A-7.

According to one embodiment, the front side 104 of the body shield 100 may have a smooth surface and be devoid of any pockets or straps, although pockets and straps may be used, if desired. The material of the body shield 100 may be of any type that is rugged and/or heavy duty.

The webbing of the body shield 100 may be reinforced and have a one of a kind strap configuration enabling the body shield 100 to be used as a shield. This unique set up may provide the user with maximum protection, and maneuverability. The reinforced stitching design may make the body shield 100 more durable, and is able to withstand extended violent impact. A horizontal strap configuration, as described in various embodiments of FIG. 1A-7, is a preferred configuration, which is unique in the field of personal protection. While a horizontal strap configuration, as described in various embodiments of FIG. 1A-7, is preferred, other configurations may be employed such as diagonally configured straps and other configurations.

Further, protective sleeves may also be used, in accordance with the present invention, to protect the forearm and wrist of the user 304 while holding the body shield 100 during its use in a defensive manner and position (e.g., defensive position 306). The body shield 100 may be equipped with nylon webbing, and quick release buckles. This nylon webbing may provide the body shield 100 with a unique strap configuration allowing it to be transformed from a backpack into a defensive shield. Three nylon webbing straps (e.g., wrist strap 112, hand strap 116, hand grip 110, and forearm strap 114) may be located on the back side 106 of the body shield 100. These nylon webbing straps may be positioned to secure the user's forearm 204, wrist, and hand 202 while defending. This positioning may allow the user 304 to securely control the body shield 100 and wield it as a shield against physical attack. The strap configuration may be horizontal, and/or diagonal depending on the user 304 preference, according to one embodiment.

In another embodiment, a built-in cut resistant arm sleeve may be added in the body shield 100 for extra protection, and support. In addition, a hook and loop fastener shoulder pads (e.g., strap cover 404) may be provided for added comfort for the user 304. The reinforced stitching throughout the body shield 100 may help with durability of the backpack.

The body shield 100 may preferably be 8 inches wide, according to one embodiment. The width of the body shield 100 may be varied based on the body frame of the user 304 (e.g., kid, woman, adolescent, man, etc.). A covered heavy duty zipper may be used to hold the front half (e.g., front side 104) and rear half (e.g., back side 106) of the body shield 100 together. Unzipping the zipper may enable the user 304 to open the body shield 100 to access the interior of the body shield 100 for storage and installation of plurality of protective inserts 118, as described in various embodiments of FIG. 1A-7. An ambidextrous side pocket may also be provided in the body shield 100 for additional storage, according to one embodiment.

According to one more embodiment, the body shield 100 of the present invention may be worn as a traditional backpack, and easily repositioned to become a defensive extension of the user's body 504, as described in various embodiments of FIG. 1A-7. The user's arm may be routed through the forearm strap 114 so that the user 304 can grasp the hand strap 116 and wrist strap 112 as shown in FIG. 2. Alternatively, the user 304 may route his arm through the forearm strap 114 and also the wrist strap 112 and grasp only the hand strap 116. This provides flexibility for the user 304 to hold the body shield 100 and the best defensive position 306 for them as possible.

As described in various embodiments of FIG. 1A-7, the body shield 100 of the present invention may provide a one of a kind strap configuration with a new and novel design setup externally and/or internally to maximize personal protection against a multitude of physical threats. This proficient configuration of the straps at the back side 106 of the body shield 100 may provide increased protection due to their efficient ability to be handheld.

The body shield 100 of the present invention may increase the user's ability to protect him/herself against gunfire. In addition, it may also protect the user 304 against various other types of attacks (e.g., knives, razors, bats, clubs, etc.). The body shield 100 may be specifically designed for personal protection against multiple attacks, and is durable. The body shield 100 of the present invention may provide a backpack configuration that can store articles and objects therein, that can also serve as a shield (e.g., using plurality of protective inserts 118) to protect the user 304 during a violent physical attack, such as by firearms, edged weapons, penetrating weapons, blunt force weapons, empty handed assault, thrown projectiles, chemical sprays, battery powered weapons, and animal attacks, according to one embodiment.

The body shield 100 of the present invention may be designed in different styles, and sizes to aid varying environments, and body sizes, though they all may have the same design characteristics. The front side 104 of the body shield 100 may be made of a cut resistant material. The rest of the body shield 100 may preferably be made of Cordura nylon. The body shield 100 may have high durability and is abrasion resistant. Bullet proof materials, such as Ultra-High-Molecular-Weight Polyethylene(UHMWPE) and/or Aramid composite fabric may be used for the protective inserts 118 as well as other known materials for each of the types of protective inserts 118, according to one embodiment.

The front side 104 of the body shield 100 may be smooth, and have no pockets, straps, or zippers. This surface may prevent the body shield 100 may from being grabbed, maximize deflection, and reduce theft. The top of the body shield 100 may have a zipper which is covered by a protective water-resistant nylon flap. This flap may also provide greater security from theft. The side of the body shield 100 may have two small pockets allowing ambidextrous use for body shield 100. The pockets may be designed to securely hold defensive weapons used in conjunction with the body shield 100, according to one embodiment.

Although the present embodiments have been described with reference to specific example embodiments, it will be evident that various modifications and changes may be made to these embodiments without departing from the broader spirit and scope of the various embodiments.

A number of embodiments have been described. Nevertheless, it will be understood that various modifications may be made without departing from the spirit and scope of the claimed invention.

The invention claimed is:

1. A body shield, comprising:

a cavity formed in an interior portion of the body shield in which items are stored, wherein the cavity formed in the interior portion of the body shield comprises at least five compartments patterned to house at least one of an anti-stab board insert, an assault board insert, an anti-trauma pad, and a bulletproof protective board insert, wherein the bulletproof protective board insert comprises a ceramic plate backed by multiple layers of a non-woven fabric film;

a plurality of horizontal straps made of one of a nylon webbing and a 1000 denier cordura material affixed on a back side of the body shield configured to enable a user of the body shield to maneuver the body shield on a human arm, to shield against a physical attack wherein the horizontal straps include:

an upper strap that is at least 1 inch wide, wrapped with a hard foam material, and anchored at a upper portion of the back side of the body shield that is connected to a hand grip on an upper top of the body shield through a fastener, a middle strap that is 1.5 inches wide and is positioned four inches from a upper region of the body shield to enable the user to securely hold the body shield in a middle of a forearm of the user, and a lower strap that is 2 inches wide to affix near an elbow of the user to provide secure rotation of the body shield while minimizing the chance of the body shield falling off from the human arm of the user;

a pair of vertical straps made of one of nylon webbing and 1000 denier cordura material affixed at the back side of the body shield to enable the user to carry the body shield and the items stored in the cavity on a human back, wherein the pair of vertical straps are detachably affixed at the back side of the body shield using at least one of a hook and loop fastener, a button fastener, a buckle fastener, and an interlocking clasp fastener, and wherein the pair of vertical straps may be one of a curved or straight configuration;

a protective sleeve affixed to the back side of the body shield to protect a user's forearm, a diagonal strap made of one of nylon webbing and 1000 denier cordura material positioned obliquely at the back side of the body shield removably enveloped by a strap cover via a hook-and-loop fastener, wherein the diagonal strap enables the user to position the body shield as a sling bag on its shoulder, and wherein the diagonal strap is detachably affixed at the back side of the body shield using at least one of a hook and loop fastener, a button fastener, a buckle fastener, and an interlocking clasp fastener;

a shoulder pad covering at least one of the vertical straps, wherein the shoulder pad includes a concealed pouch to hold a metal object, and wherein the shoulder pad is used to drive off the attacker by wielding the shoulder pad against an attacker;

a front side of the body shield made from one of a high-modulus polyethylene material and a cut resistant aramid fiber fabric; and a covered zipper configured to hold the front side and the back side together.

2. A body shield, comprising:

a cavity formed in an interior portion of the body shield in which items are stored, wherein the cavity formed in the interior portion of the body shield comprises five compartments patterned to house at least one of an anti-stab board insert, an assault board insert, an anti-trauma pad, and a bulletproof protective board insert, wherein the bulletproof protective board insert comprises a ceramic plate backed by multiple layers of a non-woven fabric film;

a plurality of horizontal straps made of a 1000 denier cordura material affixed on a back side of the body shield configured to enable a user of the body shield to maneuver the body shield on a human arm, to shield against a physical attack wherein the horizontal straps include:

an upper strap that is at least 1 inch wide, wrapped with a hard foam material, and anchored at a upper portion of the back side of the body shield that is connected to a hand grip on an upper top of the body shield through a fastener, a middle strap that is 1.5 inches wide and is positioned four inches from a upper region of the body shield to enable the user to securely hold the body shield in a middle of a forearm of the user, and a lower strap that is 2 inches wide to affix near an elbow of the user to provide secure rotation of the body shield while minimizing the chance of the body shield falling off from the human arm of the user;

a pair of vertical straps made of 1000 denier cordura material affixed at the back side of the body shield to enable the user to carry the body shield and the items stored in the cavity on a human back, wherein the pair of vertical straps may be one of a curved or straight configuration;

a protective sleeve affixed to the back side of the body shield to protect the users forearm;

a diagonal strap made of 1000 denier cordura material positioned obliquely at the back side of the body shield enveloped by a strap cover, wherein the diagonal strap enables the user to position the body shield as a sling bag on its shoulder;

a shoulder pad covering at least one of the vertical straps, wherein the shoulder pad includes a concealed pouch to hold a metal object, and wherein the shoulder pad is used to drive off the attacker by wielding the shoulder pad against an attacker;

a front side of the body shield made from a aramid fiber fabric; and a covered zipper configured to hold the front side and the back side together.

3. A body shield, comprising:

a cavity formed in an interior portion of the body shield in which items are stored, wherein the cavity formed in the interior portion of the body shield comprises five compartments patterned to house at least one of an anti-stab board insert, an assault board insert, an anti-trauma pad, and a bulletproof protective board insert, wherein the bulletproof protective board insert comprises a ceramic plate backed by multiple layers of a non-woven fabric film;

a plurality of horizontal straps made of a nylon webbing material affixed on a back side of the body shield configured to enable a user of the body shield to maneuver the body shield on a human arm, to shield against a physical attack wherein the horizontal straps include:

an upper strap that is at least 1 inch wide, wrapped with a hard foam material, and anchored at a upper portion of the back side of the body shield that is connected to a hand grip on an upper top of the body shield through a fastener, a middle strap that is 1.5 inches wide and is positioned four inches from a upper region of the body shield to enable the user to securely hold the body shield in a middle of a forearm of the user, and a lower strap that is 2 inches wide to affix near an elbow of the user to provide secure rotation of the body shield while minimizing the chance of the body shield falling off from the human arm of the user;

a pair of vertical straps made of nylon webbing material affixed at the back side of the body shield to enable the user to carry the body shield and the items stored in the cavity on a human back, wherein the pair of vertical straps may be one of a curved or straight configuration;

a protective sleeve affixed to the back side of the body shield to protect a user's forearm;

a diagonal strap made of nylon webbing material positioned obliquely at the back side of the body shield enveloped by a strap cover, wherein the diagonal strap enables the user to position the body shield as a sling bag on its shoulder;

a shoulder pad covering at least one of the vertical straps, wherein the shoulder pad includes a concealed pouch to hold a metal object, and wherein the shoulder pad is used to drive off the attacker by wielding the shoulder pad against an attacker;

a front side of the body shield made from a high-modulus polyethylene material; and a covered zipper configured to hold the front side and the back side together.

* * * * *